US009708843B2

(12) United States Patent
Geysels

(10) Patent No.: US 9,708,843 B2
(45) Date of Patent: Jul. 18, 2017

(54) METHOD FOR INSTALLING A LEAF OF A SLIDING DOOR AND SET USED THEREBY

(71) Applicant: REYNAERS ALUMINIUM, NAAMLOZE VENNOOTSCHAP, Duffel (BE)

(72) Inventor: Danny Geysels, Schoten (BE)

(73) Assignee: REYNAERS ALUMINIUM, NAAMLOZE VENNOOTSCHAP, Duffel (BE)

( * ) Notice: Subject to any disclaimer, the term of this patent is extended or adjusted under 35 U.S.C. 154(b) by 0 days.

(21) Appl. No.: 14/655,368

(22) PCT Filed: Jan. 16, 2014

(86) PCT No.: PCT/BE2014/000005

§ 371 (c)(1),
(2) Date: Jun. 25, 2015

(87) PCT Pub. No.: WO2014/121350

PCT Pub. Date: Aug. 14, 2014

(65) Prior Publication Data

US 2015/0354258 A1 Dec. 10, 2015

(30) Foreign Application Priority Data

Feb. 5, 2013 (BE) ..... 2013/0077

(51) Int. Cl.
*E05B 15/06* (2006.01)
*E05D 15/06* (2006.01)
(Continued)

(52) U.S. Cl.
CPC ..... *E05D 15/0665* (2013.01); *E04F 21/0023* (2013.01); *E05D 15/0686* (2013.01);
(Continued)

(58) Field of Classification Search
CPC . E05D 15/1665; E05D 15/0686; B25B 11/02; E04F 21/0023; E06B 3/4636
(Continued)

(56) References Cited

U.S. PATENT DOCUMENTS 3,120,033 A 2/1964 Andres
6,223,471 B1 * 5/2001 Barber ..... E05D 15/0665 49/425

(Continued)

FOREIGN PATENT DOCUMENTS

FR 2137406 A1 12/1972
FR 2363686 A2 3/1978

(Continued)

OTHER PUBLICATIONS

International Search Report, dated May 27, 2014, from corresponding PCT application.

(Continued)

*Primary Examiner* — Jerry Redman
*Assistant Examiner* — Catherine A Kelly
(74) *Attorney, Agent, or Firm* — Young & Thompson

(57) ABSTRACT

Set for installing a leaf (3) of a sliding door (1) provided with a wheel set (12) in a frame (2), the set including a leaf (3), a frame (2), a wheel set (12) and an aid (1), whereby the aid (15) includes supporting elements (17) that each define a support point (20) for the leaf (3), whereby the distance ($D_s$) between the support points (20) is less than the thickness ($D_v$) of the leaf (3) and whereby the aid (15) includes at least one connecting element (16) to fix the supporting elements (17) with respect one another.

5 Claims, 5 Drawing Sheets

(51) Int. Cl.

| | |
|---|---|
| ***E04F 21/00*** | (2006.01) |
| ***E06B 3/46*** | (2006.01) |
| *E06B 1/32* | (2006.01) |
| *E06B 3/263* | (2006.01) |

(52) U.S. Cl.
CPC ..... *E06B 3/4636* (2013.01); *E05Y 2600/56* (2013.01); *E06B 1/325* (2013.01); *E06B 2003/2639* (2013.01); *E06B 2003/26356* (2013.01)

(58) Field of Classification Search
USPC ..... 49/506
See application file for complete search history.

(56) References Cited

U.S. PATENT DOCUMENTS

| | | | | |
|---|---|---|---|---|
| 7,712,258 | B2 * | 5/2010 | Ewing | E05C 7/06 16/105 |
| 8,490,331 | B2 * | 7/2013 | Quesada | E05D 15/0665 16/18 R |
| 8,578,668 | B2 * | 11/2013 | Joray | E05D 15/0665 52/207 |
| 8,662,486 | B2 * | 3/2014 | Holder | B23P 11/00 269/152 |
| 8,806,808 | B2 * | 8/2014 | Joray | E05D 15/0665 49/425 |
| 2006/0272166 | A1 * | 12/2006 | Adkins | B23B 47/287 33/197 |
| 2015/0121764 | A1 * | 5/2015 | Lee | E05D 15/0665 49/420 |

FOREIGN PATENT DOCUMENTS

| | | | | |
|---|---|---|---|---|
| FR | 2974138 | A1 * | 10/2012 | E05D 15/0665 |
| JP | 2000185886 | A * | 7/2000 | |
| KR | WO 2008120919 | A1 * | 10/2008 | E05D 15/0686 |
| WO | 2008120919 | A1 | 10/2008 | |

OTHER PUBLICATIONS

O. Oberegge et al., "8 G Stahlbauprofile", Bautabellen fur Ingenieure, 17 (2006), XP002715354.

* cited by examiner

METHOD FOR INSTALLING A LEAF OF A SLIDING DOOR AND SET USED THEREBY

The present invention relates to a method for installing a leaf of a sliding door and a set used thereby.

More specifically the invention concerns sliding windows or sliding doors with a fixed frame secured in a wall, in which one or more leaves are fastened that can be opened or closed because they can roll on small wheels that together form a wheel set. Such a sliding window is published in FR 2.363.686 for example.

These are large windows for example that continue down to floor level and through which access can be gained to a terrace, for example, from a living room for example. They can be considered as sliding windows, but also as sliding doors. Further in this description only the word sliding door will be used, which also means a similar construction with a window character.

For aesthetic reasons there is a great demand for 'sliding doors' with a minimal aspect. This means that the outermost frame of the sliding window is concealed as much as possible in a wall and the floor, if applicable, and that the leaf profiles are kept as slim as possible.

In practice these leaf profiles are slim profiles that are fastened to a glass panel and which are entirely or partially hidden from view by the frame.

Sliding doors are traditionally installed by first installing a frame and then installing an entire leaf in this frame, by first placing the leaf in the frame at the top at a small angle, and then, lifting at the bottom, positioning the underside properly with respect to the frame and then letting the leaf descend until it is placed in the frame.

Such a method is published in U.S. Pat. No. 3,120,033, for example.

Because, with sliding doors with a minimal aspect, the leaf profile and the small wheels have to be placed in a relatively deep channel in the frame, to ensure that they are not visible, it is not easy to fit such a leaf in this way.

If a leaf, provided with small wheels, is fitted in this way in such a frame, a very large space in the top part of the frame has to be provided, such that the profile that forms the top part of the frame has to be large and expensive, with negative insulation and cost consequences. This is thus scarcely applied in practice, if at all.

Hence in practice the small wheels are first placed in the channel after which a leaf without small wheels is placed in the frame and lowered onto the small wheels. Then an excessive space is not required at the top of the frame for movements of the leaf during installation.

This is not easy, because they are often very heavy leaves, that have to be placed very precisely on the small wheels, because the small wheels have to be at a specific design distance from the sides of the leaves. Here too there is a safety risk for the people doing the installation.

Moreover, in this case the small wheels are not fixed to the leaf, the leaf only rests on the wheel set, so that an undesired mutual movement is not ruled out.

Other examples of adapted frame-leaf systems and accompanying specific methods for installing a leaf are published in FR 2.137.406 and WO 2008/120919.

The purpose of the present invention is to provide a solution to the aforementioned and other disadvantages by providing a method for installing a leaf of a sliding door provided with a wheel set in a frame with a channel provided for this purpose that comprises the following steps:

A: The placing of at least one aid in the channel that comprises supporting elements that each define a support point for the leaf, whereby the distance between the support points is less than the thickness of the leaf and whereby the aid at least comprises one connecting element to fix the supporting elements with respect to one another, whereby the aid is placed in such a way that the connecting element is lower than the support points;

B: The placing of a leaf in a vertical orientation on the support points of the aid, whereby the leaf is not yet provided with the wheel set;

C: The mounting of the wheel set on the underside of the leaf;

D: The removal of the aid and then letting the leaf descend until it is supported by the wheel set.

Hereby in step C the wheel set is normally mounted in or via the space between the supporting elements and in step C and/or step D the wheel set and/or the aid move with respect to one another via the space between the supporting elements, while the aid is in the channel.

As a result a leaf can be installed in an easy way without the frame of the sliding door having to be unnecessarily large at the top, without problems relating to the precise positioning of the small wheels and with the possibility to fasten these small wheels to the leaf.

The relatively long duration of the heavy leaf in an unstable situation, such as with the known method, is not necessary, with a positive impact on safety and a lower risk of strain complaints among the installers.

In a preferred variant step C is implemented by the leaf being provided on its underside with a groove that is open underneath and which has undercut flanks, and the wheel set is mounted on a T-shaped base whereby the base is slid in the groove.

This is an easy way to firmly and accurately fit the small wheels.

The invention also relates to a set for installing a leaf of a sliding door provided with a wheel set in a frame, which set is used in a method according to the invention and comprises a leaf, a frame, a wheel set and an aid, whereby the aid comprises supporting elements that each define a support point for the leaf, whereby the distance between the support points is less than the thickness of the leaf and whereby the aid comprises at least one connecting element to fix the supporting elements with respect one another.

Of course the wheel set has a given width and height, defined outside the invention, and the leaf has a given thickness, defined outside the invention.

In a preferred variant the supporting elements are provided with a narrowed section that extends from the support point in the direction away from the connecting element to the end of the supporting element, whereby the support point is formed by a stepped transition between the narrowed section and the rest of the supporting element, and whereby the distance between the ends of the supporting elements is greater than the thickness of the leaf.

This has the advantage that the leaf can then rest on the stepped transition, while the narrowed sections ensure that the leaf cannot slide off the aid.

The narrowed sections also act as a guide in order to get the leaf in the desired position on the aid during the last phase of lowering the leaf onto the aid.

In a further preferred embodiment the aid comprises a U-shaped profile with a back and two arms, whereby the supporting elements are formed by the arms and whereby the connecting element is formed by the back.

This is a practical embodiment.

The frame can be a frame with a channel of a given width and shape, defined outside the invention.

In a further preferred embodiment of this, the back is provided on its outside with a groove that extends in the longitudinal direction, whereby the shape of the groove is complementary to the shape of the channel.

Indeed, the channel is provided with a rail for the small wheels, whereby an aid according to the preferred embodiment is more stable in the groove because the rail lies in the groove of the aid.

In a preferred variant of the method an aid or aids as described above are used.

With the intention of better showing the characteristics of the invention, a preferred embodiment of the aid and the method according to the invention are described hereinafter by way of an example, without any limiting nature, with reference to the accompanying drawings, wherein.

Figure 1:
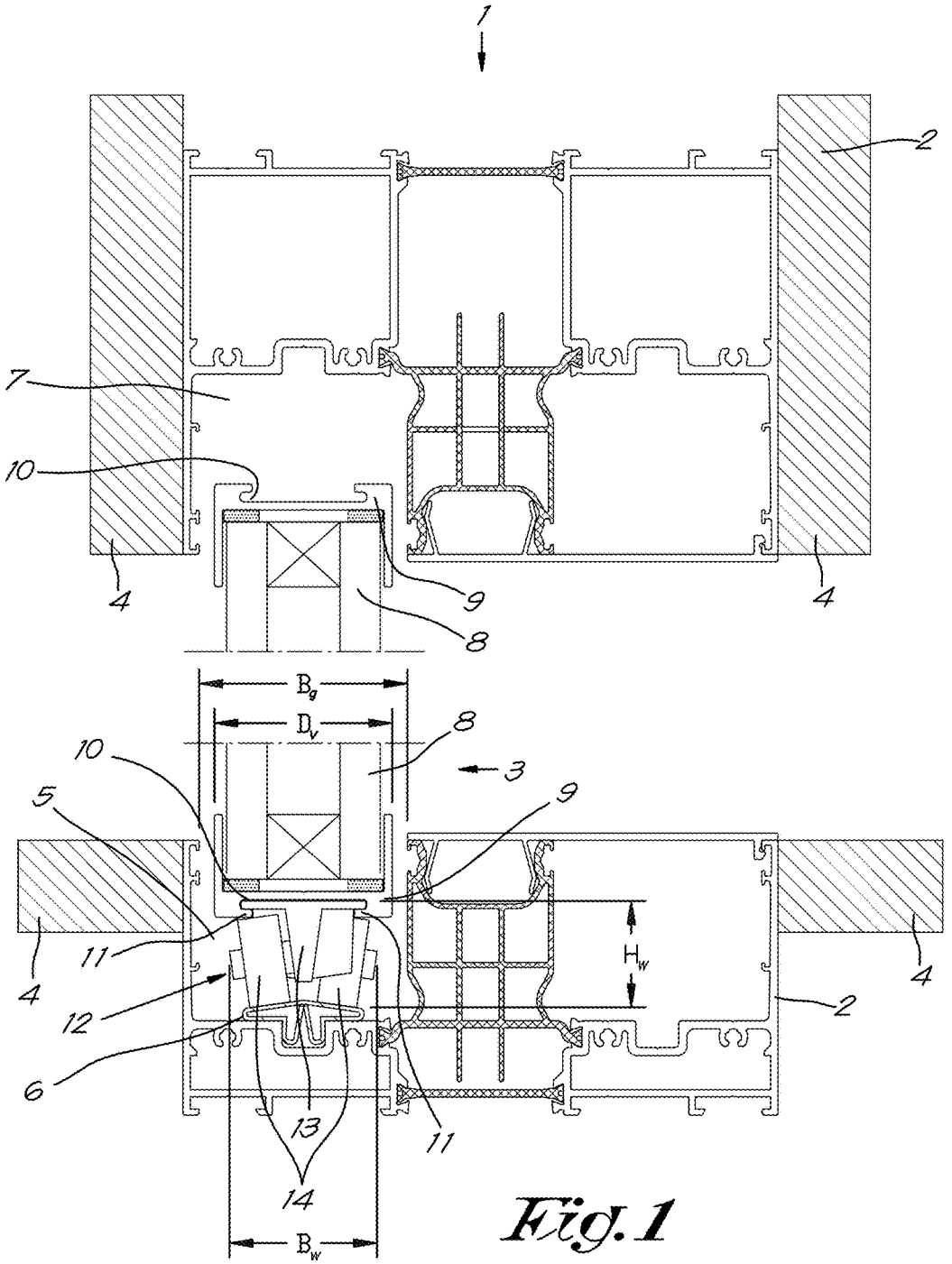
FIG. 1 shows a cross-section of a sliding door.

The sliding door 1 shown in FIG. 1 comprises a frame 2, of which only the top and the bottom are shown in this drawing, and a movable leaf 3.

The underside of the frame 2 is built into the floor 4 and has a channel 5, with a rail 6 therein. At the top there is a cavity 7 in the frame 2 for movements of the leaf 3 and the frame 2 is built into a wall there.

The leaf 3 essentially consists of a glass panel 8, on which a leaf profile 9 is fastened at the top edge, bottom edge and side edges. On the side turned away from the glass panel 8 this leaf profile 9 is provided with a groove 10 that is defined by two undercut flanks 11.

A wheel set 12 with a width $B_w$ and a height $H_W$ is affixed on the bottom edge of the leaf. This wheel set 12 essentially consists of a T-shaped base 13 that fits in the groove 10 and small wheels 14 mounted on the base. Hereby the base 13 is affixed in the groove 10, which is open underneath. The small wheels 14 rest on the rail 6 in the channel 5 and can ride on it during use in order to enable the leaf 3 to move.

Figure 2:
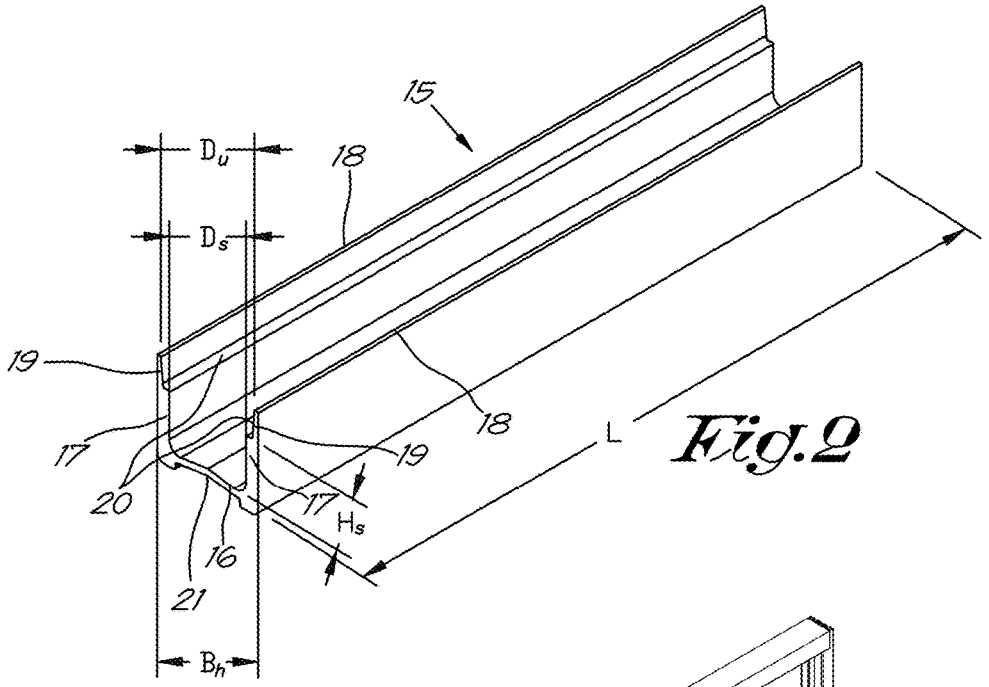
FIG. 2 shows a perspective view of an aid according to the invention.

The aid 15 shown in FIG. 2 is intended for a specific thickness $D_v$ of a leaf 3, which means the thickness on the underside of the leaf 3 and for a specific width $B_g$ of a channel.

The aid 15 has a total width $B_h$ and is formed from a profile. The profile is roughly U-shaped with a back 16 and two parallel arms 17.

Each of the arms 17, fitted to its end 18, is provided with a narrowed section 19 that runs into the rest of the arm 17 via a stepped transition 20.

The back 16 is provided with a groove 21 running in the longitudinal direction L that has a corresponding shape and size to the rail 6 of a frame 2 for which the aid 15 is intended. The width $B_h$ of the aid 15 is such that it fits quite well in the channel of such a frame 2.

The aid 15 described above can more generally be described as being an aid that comprises two supporting elements, which in this case are formed by the arms 17 and a connecting element in order to fix the supporting elements with respect one another, which in this case is formed by the back 16.

Such an aid 15 is used as follows to install a leaf 3 of a sliding door 1 in a frame 2.

This method concerns the installation of a leaf 3 with a certain width $B_v$, whereby two aids 15 are used and is described on the basis of FIGS. 3 to 7.

First the two aids 15 are selected, that fit to the dimensions and shape of the channel 5, and of the leaf 3 that has to be installed.

To this end the width $B_h$ of the aid 15 has to be smaller than the width $B_g$ of the channel 5, so that the aid 15 fits freely in the channel 5.

The distance $D_u$ between the end 18 of the arms 17 must be greater than the thickness $D_v$ of the leaf 3.

The distance $D_s$ between the arms 17 at the location of the stepped transition 20 must be less than the thickness $D_v$ of the leaf 3, so that the stepped transitions 20 can form support points for the leaf 3.

This distance $D_s$ must be greater than the width $B_w$ of the wheel set 12, and the distance $H_s$ between the stepped transitions 20 and the back 16 must be greater than the height $H_w$ of the wheel set 12, to ensure that the wheel set 12 fits in the space between the arms 17.

Figure 3:
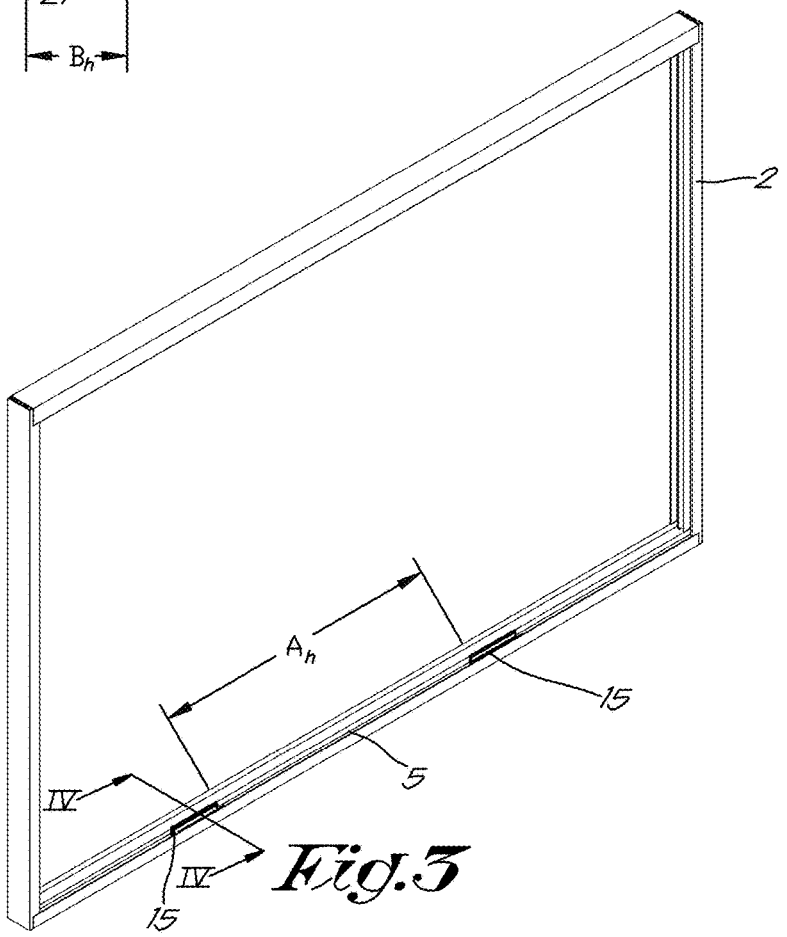
FIG. 3 shows a perspective view of a frame of a sliding door, during a first step in a method according to the invention.
Figure 4:
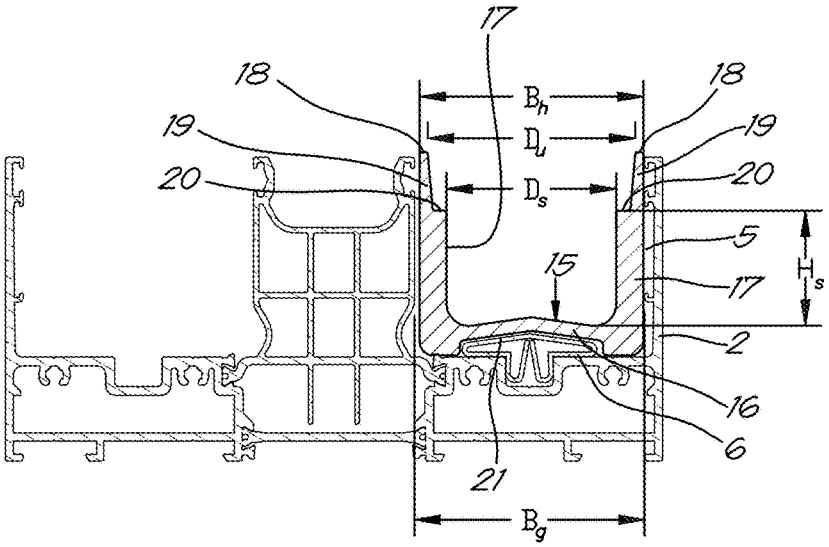
FIG. 4 shows a cross-section according to line VI-VI of the frame of FIG. 3.

The two aids 15 are placed in the channel 5 of the frame 3, with a distance $A_h$ between them that is less than the width $B_v$ of the leaf 3. This is shown in FIGS. 3 and 4. Thanks to the dimensions of an aid 15 and the shape of the back 16, the aids 15 are hereby only slightly movable sideways, i.e. in a direction perpendicular to the plane in which the leaf 3 lies.

Then a leaf 3, which in this case is not provided with a wheel set 12, is placed by its top edge in the cavity 7 at the top of the frame 2, with a slight deviation from a completely vertical orientation.

Then the leaf 3 is placed in a vertical orientation to above the aids 15. Hereby the top of the leaf 3 only has to be placed in the cavity 7 at the top of the frame 3 over a small distance, because there are still no small wheels 14 that could come into contact with the aids 15 or with the frame 2 or the floor 4.

The leaf 3 is now lowered onto the aids 15, whereby the narrowed sections 19 of the arms 17 of the aids 15 provide a certain guide for the leaf 3 and the stepped transitions 20 form support points for the leaf 3. Hereby the leaf 3 is fitted such that the side edges, thus the vertical edges of the leaf 3, are each above an aid 15.

Figure 5:
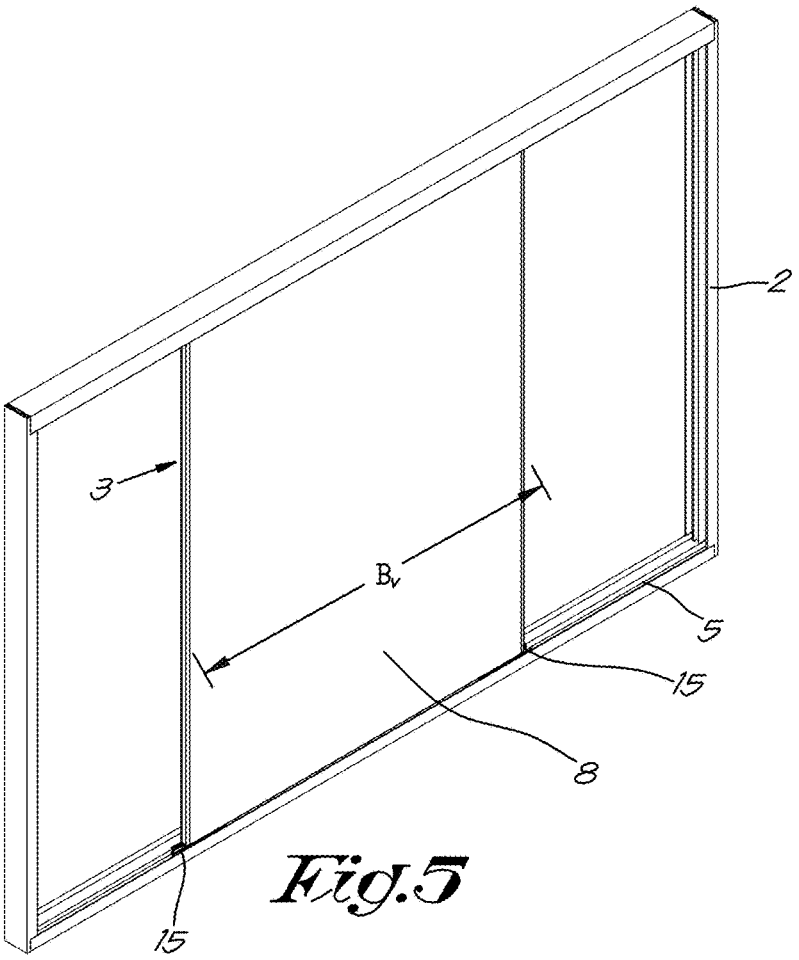
FIG. 5 shows a perspective view of a frame and leaf of a sliding door, during a subsequent step in a method according to the invention.

The situation now obtained is shown in FIG. 5.

Figure 6:
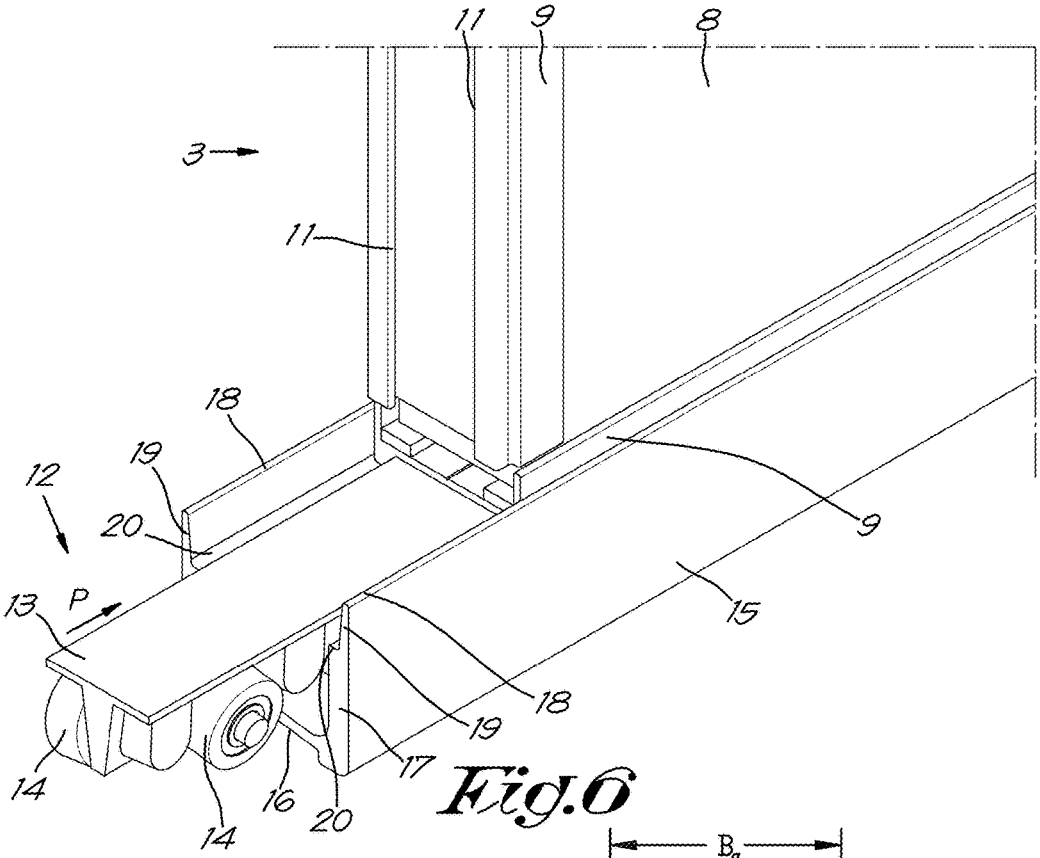
FIG. 6 shows a perspective view of a detail of a leaf and an aid according to the invention during a later subsequent step in a method according to the invention.
Figure 7:
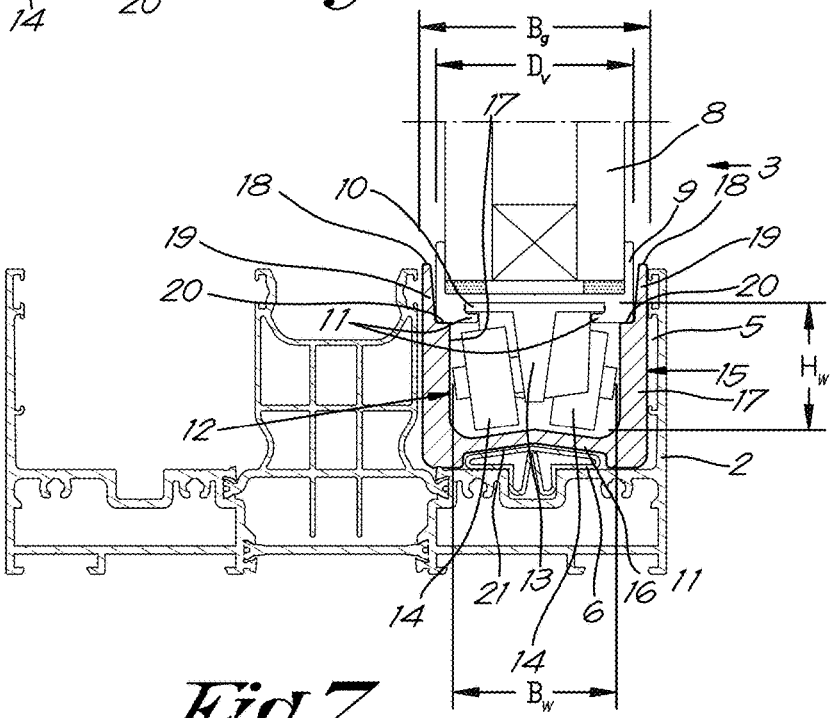
FIG. 7 shows a cross-section analogous to FIG. 4 of a sliding door during the step of the method shown in FIG. 6.

Then a wheel set 12 is mounted underneath the leaf 3 from both sides by sliding the base 13 of the wheel set 12 in the groove 10 of the bottom leaf profile 9 in the direction of arrow P, as shown in FIGS. 6 and 7, until the wheel sets 12 are completely under the leaf 3. The wheel sets 12 are thus hereby fitted via the space between the arms 17 of the aids 15.

In order to ensure the correct position of the bases 13, an end stop for each base 13 can be provided in the groove 10. There can also be facilities to fasten a base 13 in the groove 10, so that the wheel set 12 cannot move with respect to the leaf 3.

Figure 8:
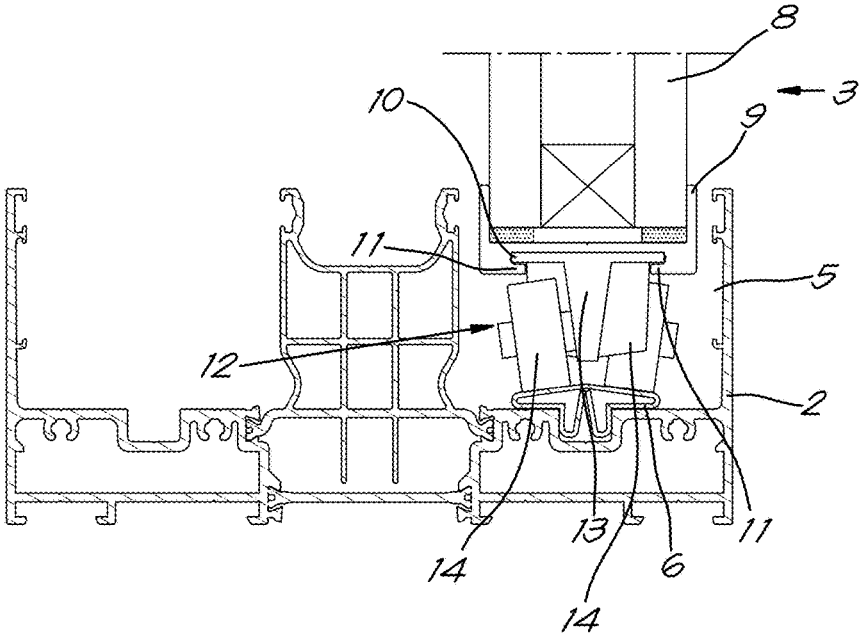
FIG. 8 shows a cross-section analogous to FIG. 7 but after the final step of the method.

Then the leaf 3 is again raised over a small distance, the aids 15 are slid in the longitudinal direction of the channel 5 from under the small wheels 14 and the leaf 3 is again lowered until the small wheels 14 rest on the rail 6 and the leaf 3 is thereby supported by the wheel sets 12, so that the situation shown in FIG. 1 and FIG. 8 is obtained.

The leaf 3 is now installed and can move, or roll on the small wheels 14, in the channel 5.

The present invention is by no means limited to the embodiment described as an example and shown in the drawings, but an aid and method according to the invention can be realised in all kinds of forms, dimensions and variants without departing from the scope of the invention.

The invention claimed is:

1. A method for installing a sliding door (1) with an aid, wherein the sliding door includes a leaf (3), a frame (2), and a plurality of wheels forming a wheel set (12) for supporting a lower side of the leaf in the frame and that is not affixed to the leaf before installation of the sliding door, an upper side of the frame having a cavity (7) and a lower side of the frame having a channel (5) in which the leaf, when mounted in the frame, slides supported by the wheel set, a lower side of the leaf having a thickness ($D_v$) smaller than an interior width ($B_g$) of the channel in the lower side of the frame, and wherein the aid (15), which is not affixed to any of the leaf, the frame, and the wheel set, includes two supporting elements (17) that each defines, at an upper portion, a respective support (20) for the lower side of the leaf (3), and at least one connecting element (16) that fixes the two supporting elements with respect to one another and defines a space between the two supporting elements that receives the wheel set between the two supporting elements, wherein an interior distance ($D_s$) between the supports (20) is less than the thickness ($D_v$) of the lower side of the leaf (3), and wherein the aid (15) with its two supporting elements has a maximum width ($B_h$) that is less than the interior width ($B_g$) of the channel so that the two supporting elements fit in the channel, the method comprising the following steps:

A: placing the aid (15) in the channel (5) with the connecting element (16) lower than the supports (20);

B: after placing the aid in the channel and before the wheel set (12) is installed, placing the leaf (3), without the wheel set, in a vertical orientation with the lower side of the leaf on the supports (20);

C: after placing the leaf on the supports, placing the wheel set (12) in the channel underneath the lower side the leaf (3); and D: after placing the wheel set underneath the leaf, removing the aid (15) from the channel and then lowering the leaf (3) until it is supported by the wheel set (12).

2. The method according to claim 1, wherein in step C the wheel set (12) is mounted in or via a space between the two supporting elements (17).

3. The method according to claim 1, wherein in step C the wheel set (12) and the aid (15) are movable with respect to one another while the aid (15) is in the channel.

4. The method according to claim 1, wherein in step A, a further said aid (15) is provided, and in step B the leaf (3) is placed on both said aids (15) in such a way that above each of the two aids (15) there is a respective vertical edge of the leaf (3), and in step D both said aids (15) are removed.

5. The method according to claim 1, wherein step C is implemented by providing the leaf (3) with a groove (10) on its underside that is open underneath and which has undercut flanks (11) and the wheel set (12) comprises a T-shaped base (13), wherein the base (13) slides in the groove (10).

* * * * *